US012595809B2

(12) United States Patent
Wu et al.

(10) Patent No.: US 12,595,809 B2
(45) Date of Patent: Apr. 7, 2026

(54) HEAT COLLECTING PUMP AND WASHING APPLIANCE HAVING THE SAME

(71) Applicant: FOSHAN SHUNDE MIDEA WASHING APPLIANCES MANUFACTURING CO., LTD., Foshan (CN)

(72) Inventors: Jianqing Wu, Foshan (CN); Richao Liu, Foshan (CN); Xiang Li, Foshan (CN); Canhua Qiu, Foshan (CN); Pingping Xu, Foshan (CN)

(73) Assignee: FOSHAN SHUNDE MIDEA WASHING APPLIANCES MANUFACTURING CO., LTD., Foshan (CN)

( * ) Notice: Subject to any disclaimer, the term of this patent is extended or adjusted under 35 U.S.C. 154(b) by 0 days.

(21) Appl. No.: 18/913,769

(22) Filed: Oct. 11, 2024

(65) Prior Publication Data

US 2025/0035129 A1 Jan. 30, 2025

Related U.S. Application Data

(63) Continuation of application No. 18/518,391, filed on Nov. 22, 2023, now Pat. No. 12,234,835, which is a (Continued)

(30) Foreign Application Priority Data

Apr. 30, 2020 (CN) ..... 202010365913.9
Apr. 30, 2020 (CN) ..... 202020714834.X
(Continued)

(51) Int. Cl.
*F04D 29/44* (2006.01)
*A47L 15/42* (2006.01)
*F04D 29/58* (2006.01)

(52) U.S. Cl.
CPC ..... *F04D 29/447* (2013.01); *F04D 29/586* (2013.01); *A47L 15/4225* (2013.01); *A47L 15/4285* (2013.01)

(58) Field of Classification Search
CPC ..... F04D 29/448; F04D 29/586
See application file for complete search history.

(56) References Cited

U.S. PATENT DOCUMENTS 9,145,901 B2 9/2015 Li et al.
2019/0093671 A1* 3/2019 Hoffmann ..... F04D 29/448

FOREIGN PATENT DOCUMENTS

CN 107503980 A 12/2017
CN 107514392 A 12/2017
(Continued)

OTHER PUBLICATIONS

The China National Intellectual Property Administration (CNIPA) The Second Office Action for Chinese Application 202011241371.0 Dec. 31, 2024 22 Pages (With Translation).
(Continued)

*Primary Examiner* — Brian O Peters
(74) *Attorney, Agent, or Firm* — Anova Law Group, PLLC

(57) ABSTRACT

A heat collecting pump includes a housing with an accommodation cavity and having fluid inlet and outlet, a heating device disposed in the accommodation cavity and including a heating tube, a drive device connected to the housing and configured to drive a fluid to flow from the fluid inlet to the fluid outlet, and a flow guiding element disposed in the accommodation cavity. The flow guiding element has an inner wall forming a fluid inlet channel in communication with the fluid inlet. A fluid discharge channel is formed between an outer wall of the flow guiding element and an inner wall of the accommodation cavity, and is in communication with the fluid inlet channel and the fluid outlet. The
(Continued)

flow guiding element includes a flow guiding portion and a water inlet portion. The heating tube is sleeved on and spaced apart from the water inlet portion.

18 Claims, 6 Drawing Sheets

Related U.S. Application Data continuation of application No. 17/921,345, filed as application No. PCT/CN2021/089998 on Apr. 26, 2021, now Pat. No. 11,879,479.

(30) Foreign Application Priority Data

Nov. 9, 2020 (CN) ..... 202011241371.0
Nov. 9, 2020 (CN) ..... 202022578284.6

(56) References Cited

FOREIGN PATENT DOCUMENTS

| | | | |
|---|---|---|---|
| CN | 108194423 | A | 6/2018 |
| CN | 108331785 | A | 7/2018 |
| CN | 109154308 | A | 1/2019 |
| CN | 110080988 | A | 8/2019 |
| CN | 110631268 | A | 12/2019 |
| CN | 110822718 | A | 2/2020 |
| CN | 111481146 | A | 8/2020 |
| CN | 111481147 | A | 8/2020 |
| CN | 112244729 | A | 1/2021 |
| CN | 212394857 | U | 1/2021 |
| CN | 214484443 | U | 10/2021 |
| DE | 102011003464 | A1 | 4/2012 |
| EP | 2495444 | A2 | 9/2012 |
| EP | 2628958 | A2 | 8/2013 |
| JP | S5412103 | U | 1/1979 |
| JP | 2012518262 | A | 8/2012 |
| WO | 2006136819 | A2 | 12/2006 |
| WO | 2017206230 | A1 | 12/2017 |

OTHER PUBLICATIONS

The European Patent Office (EPO) Office Action for Application No. 21797046.6 Sep. 29, 2023 7 Pages.
United States Patent and Trademark Office (USPTO) Egrant Notification for U.S. Appl. No. 17/921,345, Jan. 23, 2024 2 Pages.
The World Intellectual Property Organization (WIPO) International Search Report and Written Opinion for PCT/CN2021/089998 Jul. 14, 2021 17 Pages (including translation).
China National Intellectual Property Administration (CNIPA) Office Action 1 for Application No. 202010365913.9 Jan. 12, 2021 18 Pages (including translation).
China National Intellectual Property Administration (CNIPA) Office Action 2 for Application No. 202010365913.9 Jul. 21, 2021 15 Pages (including translation).
State Intellectual Property Office of China Notice of Grant of Invention Patent Right for Application No. 202010365913.9 Jan. 18, 2022 3 pages (including translation).
China National Intellectual Property Administration (CNIPA) Office Action 1 for Application No. 202011241371.0 Jun. 27, 2024 19 Pages (including translation).
The European Patent Office (EPO) The communication pursuant of Article 94(3) EPC Aug. 7, 2025 4 Pages.

* cited by examiner

HEAT COLLECTING PUMP AND WASHING APPLIANCE HAVING THE SAME

CROSS-REFERENCE TO RELATED APPLICATIONS

This application is a continuation of U.S. application Ser. No. 18/518,391, filed on Nov. 22, 2023, which is a continuation of U.S. application Ser. No. 17/921,345, filed on Oct. 25, 2022, now U.S. Pat. No. 11,879,479, which is a national stage entry of International Application No. PCT/CN2021/089998, filed on Apr. 26, 2021, which claims priority to Chinese Patent Application Nos. 202010365913.9 and 202020714834.X, both filed on Apr. 30, 2020, and to Chinese Patent Application Nos. 202022578284.6 and 202011241371.0, both filed on Nov. 9, 2020, the entire disclosures of all of which are incorporated herein by reference.

FIELD

The present disclosure relates to the technical field of household electrical appliances, and more particularly, to a heat collecting pump and a washing appliance having the same.

BACKGROUND

In the related art, in a heat collecting pump, a heating tube is typically placed in a pump housing, and water in the pump housing may be heated by means of the heating tube. However, the arrangement of the heating tube would result in a loss of fluid efficiency, which may affect operation performance of the heat collecting pump.

SUMMARY

The present disclosure aims to at least solve one of the technical problems existing in the related art. To this end, embodiments of the present disclosure provide a heat collecting pump that can improve fluid efficiency.

Embodiments of the present disclosure further provide a washing appliance having the heat collecting pump as described above.

A heat collecting pump according to embodiments of a first aspect of the present disclosure includes a housing, a heating device, a drive device, and a flow guiding element. The housing has an accommodation cavity, and has a fluid inlet, a fluid outlet, and a mounting opening. The heating device is disposed in the accommodation cavity. The drive device is connected to the housing and configured to drive a fluid to flow from the fluid inlet to the fluid outlet. The flow guiding element is disposed in the accommodation cavity. The flow guiding element has an inner wall forming a fluid inlet channel in communication with the fluid inlet. A fluid discharge channel is formed between an outer wall of the flow guiding element and an inner wall of the accommodation cavity. The fluid discharge channel is in communication with the fluid inlet channel and the fluid outlet. The flow guiding element has a flow guiding portion configured to guide a fluid in the fluid discharge channel towards the fluid outlet. The heating device includes a heating tube. The flow guiding element includes a water inlet portion. The heating tube is sleeved around the water inlet portion, and is spaced apart from the water inlet portion.

In the heat collecting pump according to the embodiments of the present disclosure, the flow guiding element is disposed in the housing, and the flow guiding element is constructed to divide a space in the accommodation cavity into the fluid inlet channel and the fluid discharge channel that are radially spaced apart from each other and in communication with each other at their bottoms. In this way, flowing of water into the heat collecting pump does not interfere with discharging of water out of the heat collecting pump. In addition, water flow entering the accommodation cavity can be guided according to a position and an opening direction of the fluid outlet. As a result, fluid efficiency of the heat collecting pump is improved.

According to some embodiments of the present disclosure, the water inlet portion has an inner wall forming the fluid inlet channel. The water inlet portion has an end directly facing towards the fluid inlet. The flow guiding portion is disposed at another end of the water inlet portion.

Further, the water inlet portion abuts against the housing at the fluid inlet, and the flow guiding portion abuts against the drive device.

In some embodiments, the flow guiding portion includes a connection body and a plurality of flow guiding ribs. The connection body has an end connected to the water inlet portion and another end obliquely extending outwards away from the water inlet portion. The plurality of flow guiding ribs arranged at intervals at another end of the connection body in a circumferential direction of the connection body.

Further, a cross-sectional area of at least part of the connection body gradually increases from an end of the connection body adjacent to the water inlet portion to an end of the connection body facing away from the water inlet portion. The at least part of the connection body covers an impeller of the drive device, and is spaced apart from the impeller in an axial direction of the impeller.

According to some embodiments of the present disclosure, the water inlet portion includes a circular tube segment. The connection body includes a transition segment and a disc segment. The transition segment is connected to the circular tube segment and the disc segment. The plurality of flow guiding ribs is arranged at an outer edge of the disc segment. The circular tube segment and the disc segment are concentrically arranged to each other.

According to some embodiments of the present disclosure, each of the plurality of flow guiding ribs is formed as a spiral rib spirally extending in an axial direction of the water inlet portion. The plurality of flow guiding ribs is arranged at equal intervals in parallel in the circumferential direction of the connection body.

According to some embodiments of the present disclosure, an outer peripheral wall of the water inlet portion at least partially has a cylindrical surface. Each of the plurality of flow guiding ribs has a first flow guiding surface and a second flow guiding surface. The first flow guiding surface spirally extends in the axial direction of the water inlet portion, and the second flow guiding surface spirally extends in the axial direction of the water inlet portion. The first flow guiding surface is perpendicular to the cylindrical surface, and the second flow guiding surface is parallel to the cylindrical surface.

Further, the flow guiding rib includes a transverse side plate extending transversely and a longitudinal side plate extending longitudinally. The first flow guiding surface is located at the transverse side plate, and the second flow guiding surface is located at the longitudinal side plate. The first flow guiding surface and the second flow guiding surface are connected to each other in an extending direction of the flow guiding rib.

In some embodiments, at least part of the first flow guiding surface is located at a side of the connection body facing away from the water inlet portion, and a width of the at least part of the first flow guiding surface is constant or gradually decreases from the connection body to a free end of the at least part of the first flow guiding surface.

In other embodiments, at least part of the first flow guiding surface is located at a side of the connection body adjacent to the water inlet portion, and a width of the at least part of the first flow guiding surface is constant or gradually decreases from the connection body to a free end of the at least part of the first flow guiding surface.

According to some embodiments of the present disclosure, the flow guiding rib further includes a support leg. The support leg has an end connected to the longitudinal side plate and another end extending away from the water inlet portion. The support leg is adapted to support the drive device.

Further, the support leg has a support surface. The flow guiding rib has a second flow guiding surface, and the support surface is parallel to the second flow guiding surface.

According to some embodiments of the present disclosure, the drive device is located at a side of the flow guiding element in an axial direction of the flow guiding element. The drive device includes an impeller assembly, and the flow guiding portion is supported at an outer side of the impeller assembly.

Further, the flow guiding portion has a first flow guiding surface. A distance between an end of the first flow guiding surface adjacent to the drive device and an end of the impeller assembly facing away from the flow guiding element ranges from ⅓ to ¾ of a thickness of the impeller assembly in an axial direction of the impeller assembly.

According to some embodiments of the present disclosure, the flow guiding element is provided with an inserting portion adapted to be inserted and engaged into the fluid inlet.

A washing appliance according to embodiments of a second aspect of the present disclosure includes the heat collecting pump according to the embodiments of the first aspect of the present disclosure.

In the washing appliance according to the present disclosure, by providing the heat collecting pump as described in the first aspect, the fluid efficiency is improved.

Additional aspects and advantages of the present disclosure will be in part set forth below, become apparent in part from the following description, or can be learned by practice of the present disclosure.

Figure 1:
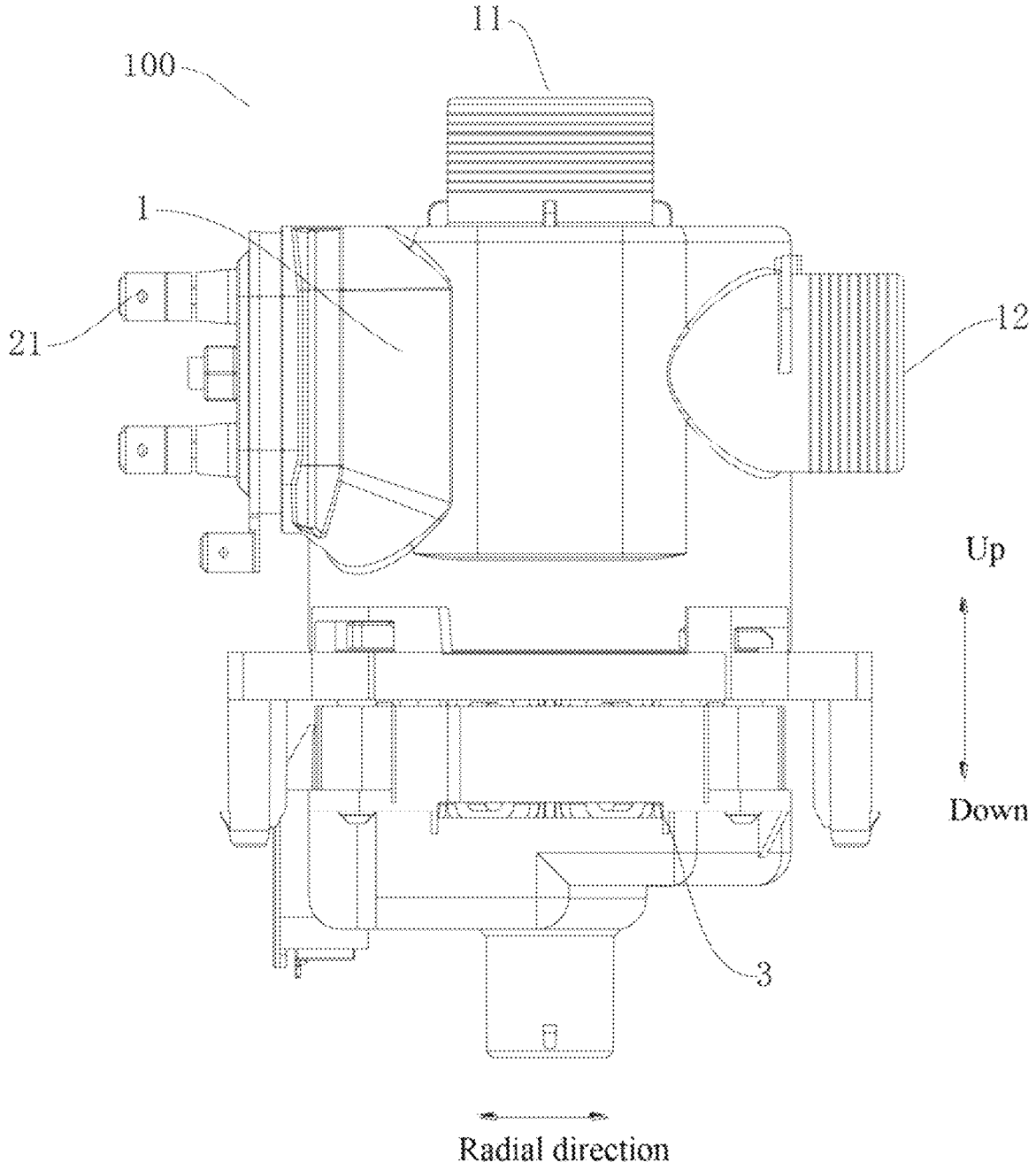
FIG. 1 is a schematic view of a heat collecting pump according to an embodiment of a first aspect of the present disclosure.

REFERENCE NUMERALS heat collecting pump 100,
housing 1, fluid inlet 11, fluid outlet 12, mounting opening 13,
heating device 2, wiring terminal 21, heating tube 22,
drive device 3, impeller assembly 31, impeller mounting surface 32,
flow guiding element 4, water inlet portion 41, inserting portion 411, flow guiding portion 42, connection body 421, transition segment 422, disc segment 423, flow guiding rib 424, transverse side plate 425, longitudinal side plate 426, and support leg 427.

DETAILED DESCRIPTION OF THE EMBODIMENTS

Embodiments of the present disclosure will be described in detail below with reference to examples thereof as illustrated in the accompanying drawings, throughout which same or similar elements, or elements having same or similar functions, are denoted by same or similar reference numerals. The embodiments described below with reference to the accompanying drawings are exemplary, only used to explain the present disclosure, and should not be construed as a limitation on the present disclosure.

A heat collecting pump 100 according to embodiments of a first aspect of the present disclosure will be described below with reference to FIG. 1 to FIG. 6.

Figure 2:
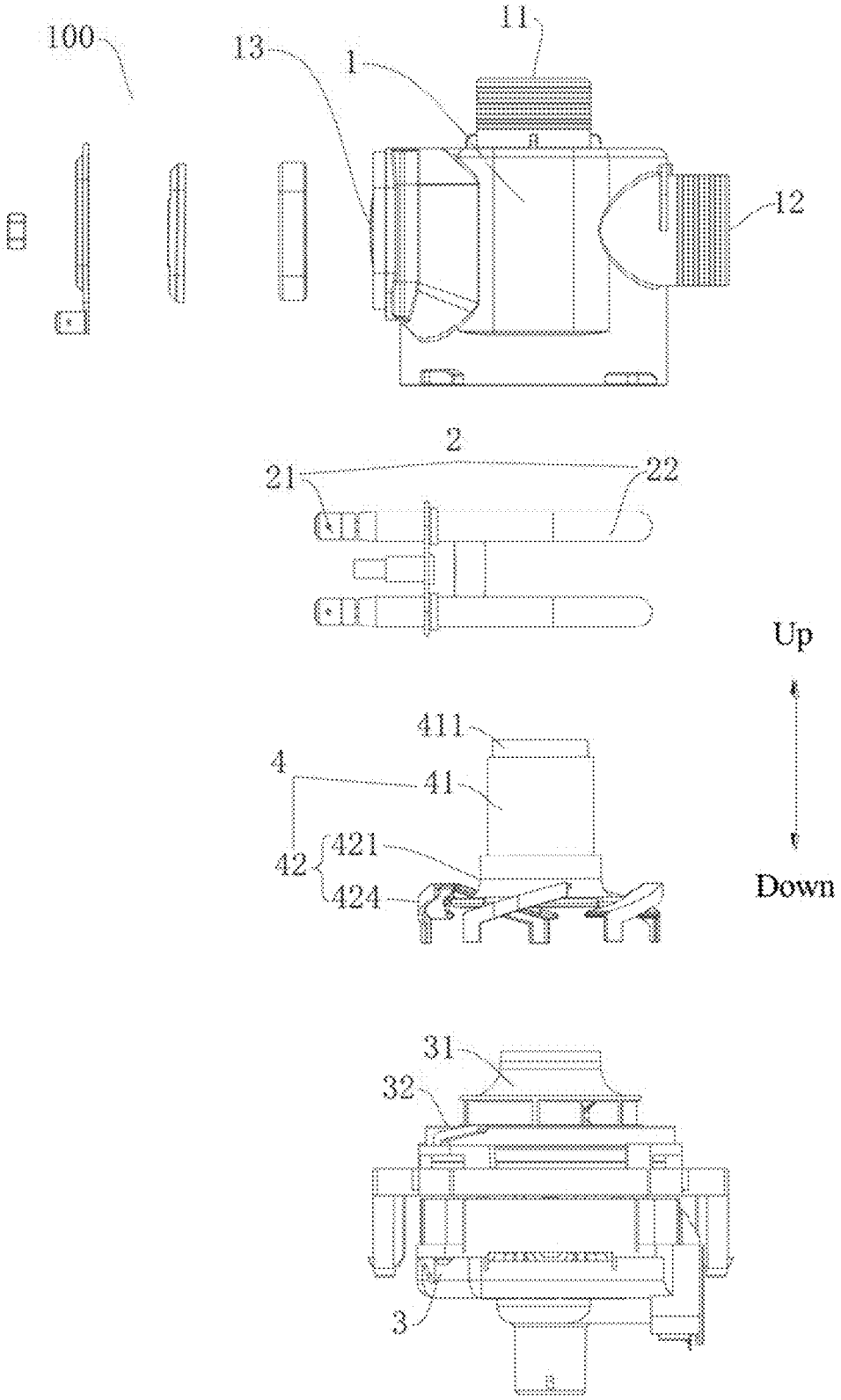
FIG. 2 is a schematic exploded view of the heat collecting pump shown in FIG. 1.

Referring to FIG. 1 and FIG. 2, the heat collecting pump 100 according to the embodiments of the first aspect of the present disclosure includes a housing 1, a heating device 2, a drive device 3, and a flow guiding element 4.

In an exemplary embodiment of the present disclosure, as shown in FIG. 2, the housing 1 has an accommodation cavity, which may be generally formed into a cylindrical shape with an open end. The housing 1 has a fluid inlet 11, a fluid outlet 12, and a mounting opening 13. The fluid inlet 11 may be formed at a top of the housing 1. The fluid outlet 12 may be formed at a side wall of the housing 1. The mounting opening 13 may be formed at the side wall or top of the housing 1. In some embodiments, the mounting opening 13 may be formed at the side wall of the housing 1 and be spaced apart from the fluid outlet 12, and may be configured for mounting of other components of the heat collecting pump 100 such as the heating device 2. It may be understood that influence of the components mounted at the mounting opening 13 on a fluid within the housing 1 should be avoided or reduced when forming the mounting opening 13.

The heating device 2 is disposed in the accommodation cavity. For example, the heating device 2 may be fixed at the mounting opening 13. A main body of the heating device 2, such as a heating tube 22, is disposed in the accommodation cavity. In addition, a wiring terminal 21 of the heating device 2 may extend out of the housing 1 through the mounting opening 13 for connecting with an external power source.

The drive device 3 is connected to the housing 1. For example, the drive device 3 may be connected to the open end of the housing 1. The drive device 3 is configured to drive a fluid to flow from the fluid inlet 11 to the fluid outlet 12. The flow guiding element 4 is disposed in the accommodation cavity. The flow guiding element 4 has an inner wall forming a fluid inlet channel. The fluid inlet channel is in communication with the fluid inlet 11. A fluid discharge channel is formed between an outer wall of the flow guiding element 4 and an inner wall of the accommodation cavity. The fluid discharge channel is in communication with the fluid inlet channel and the fluid outlet 12. The flow guiding element 4 has a flow guiding portion 42 configured to guide a fluid in the fluid discharge channel towards the fluid outlet 12. In this way, the drive device 3 can drive the fluid to enter the fluid inlet channel from the fluid inlet 11 to reach the drive device 3. After the fluid is pressurized and accelerated by the drive device 3, the fluid is guided by the flow guiding element 4 in the fluid discharge channel and then flows out of the fluid outlet 12.

For example, as shown in FIG. 2, the flow guiding element 4 divides a space of the accommodation cavity into the fluid inlet channel and the fluid discharge channel that are radially spaced apart from each other and in communication with each other at their bottoms. In this way, flowing of water into the heat collecting pump 100 does not interfere with discharging of water out of the heat collecting pump 100. Meanwhile, since opening orientations of the fluid outlet 12 and the fluid inlet 11 are perpendicular to each other, by providing the flow guiding portion 42 in the fluid discharge channel, the influence on a fluid pressure and flow rate may be reduced as much as possible while changing a flow direction after the fluid is guided by the flow guiding portion 42. As a result, water flows out of the fluid outlet 12 in a direction parallel to an axial direction of the fluid outlet 12.

In the heat collecting pump 100 according to the embodiments of the present disclosure, the flow guiding element 4 is disposed in the housing 1, and the flow guiding element 4 is constructed to divide the space in the accommodation cavity into the fluid inlet channel and the fluid discharge channel that are radially spaced apart from each other and in communication with each other at their bottoms. In this way, flowing of the water into the heat collecting pump 100 does not interfere with discharging of the water out of the heat collecting pump 10. In addition, water flow entering the accommodation cavity can be guided according to a position and an opening direction of the fluid outlet 12. As a result, fluid efficiency of the heat collecting pump is improved.

Figure 3:
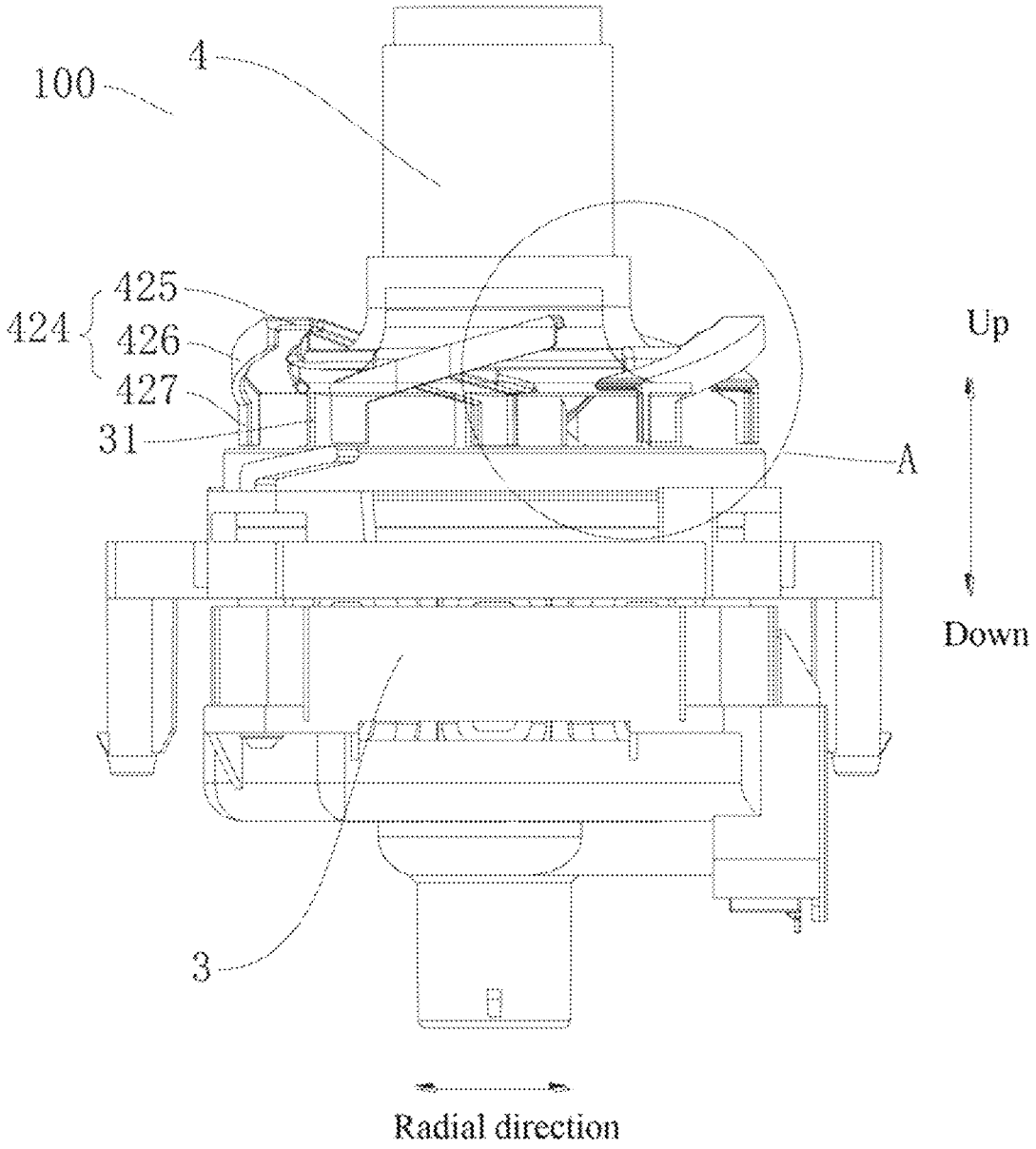
FIG. 3 is a schematic view of an assembly of a flow guiding element and a drive device of the heat collecting pump shown in FIG. 1.

According to some embodiments of the present disclosure, referring to FIG. 2 and FIG. 3, the flow guiding element 4 includes a water inlet portion 41. The water inlet portion 41 has an inner wall forming the fluid inlet channel. The water inlet portion 41 has an end directly facing towards and in communication with the fluid inlet 11. For example, as shown in FIG. 2, an upper end of the water inlet portion 41 may be in direct communication with the fluid inlet 11 or in communication with the fluid inlet 11 via a connection tube. The flow guiding portion 42 may be disposed at the other end of the water inlet portion 41. For example, the flow guiding portion 42 may be disposed at a lower end of the water inlet portion 41. In this way, after entering the fluid inlet channel from the fluid inlet 11, the water flow can sequentially pass through the drive device 3 and the flow guiding portion 42. Finally, the pressurized and guided water flow can be discharged through the fluid outlet 12.

Further, the water inlet portion 41 abuts against the housing 1 at the fluid inlet 11. The flow guiding portion 42 abuts against the drive device 3. In this way, it is possible to facilitate fixing of the flow guiding element 4 and realization of the flow guiding.

In some embodiments, referring to FIG. 3 to FIG. 6, the flow guiding portion 42 may include a connection body 421 and a plurality of flow guiding ribs 424. In an exemplary embodiment of the present disclosure, an end of the connection body 421 (for example, an upper end of the connection body 421 shown in FIG. 5) is connected to the water inlet portion 41. Another end of the connection body 421 (for example, a lower end of the connection body 421 shown in FIG. 4) obliquely extends outwards away from the water inlet portion 41. The plurality of flow guiding ribs 424 may be disposed at the other end of the connection body 421. The plurality of flow guiding ribs 424 may be arranged at intervals in a circumferential direction of the connection body 421. Therefore, a structure is simple, and it is easy to processing and molding.

Figure 5:
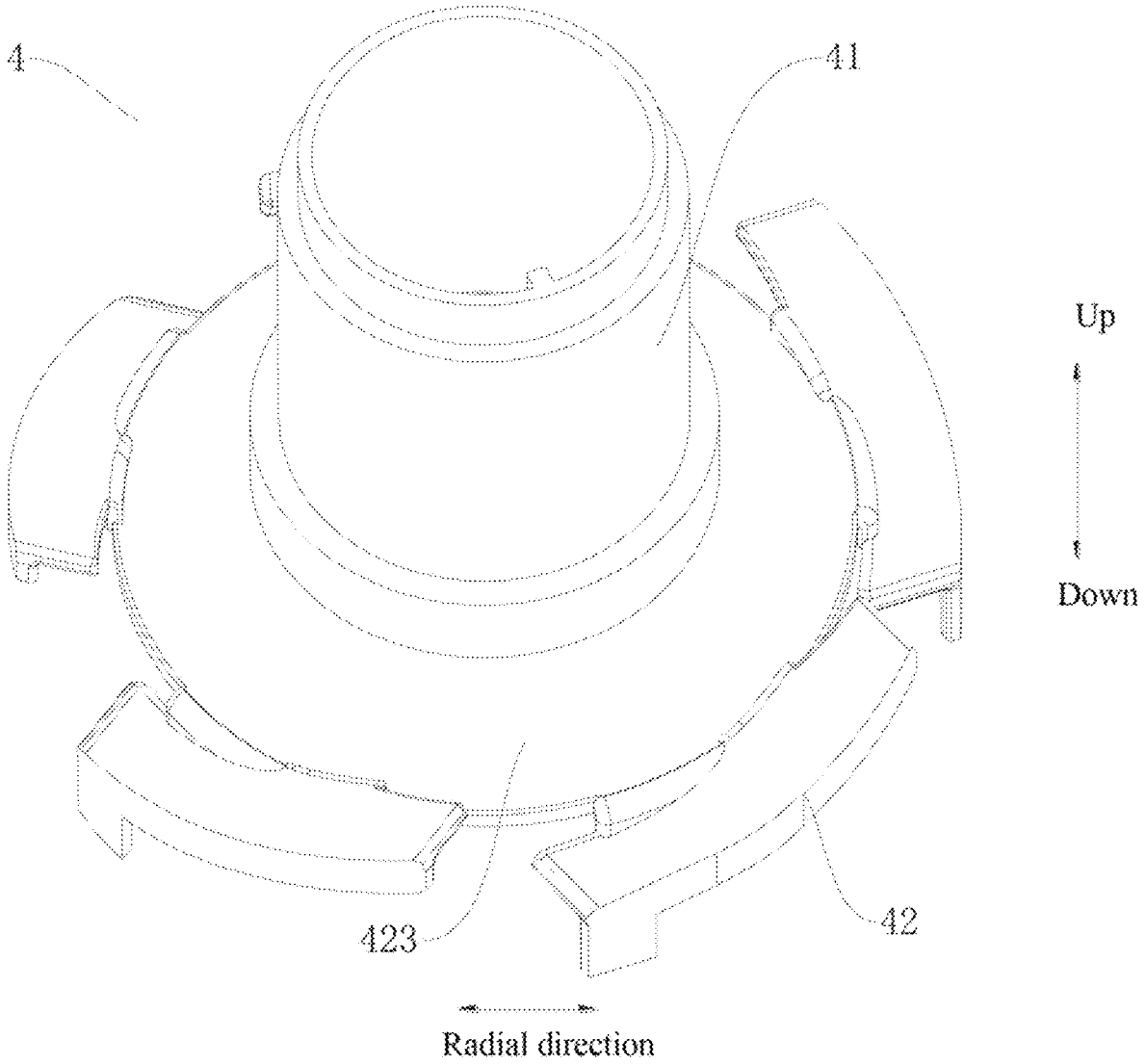
FIG. 5 is a top view of the flow guiding element shown in FIG. 2.
Figure 6:
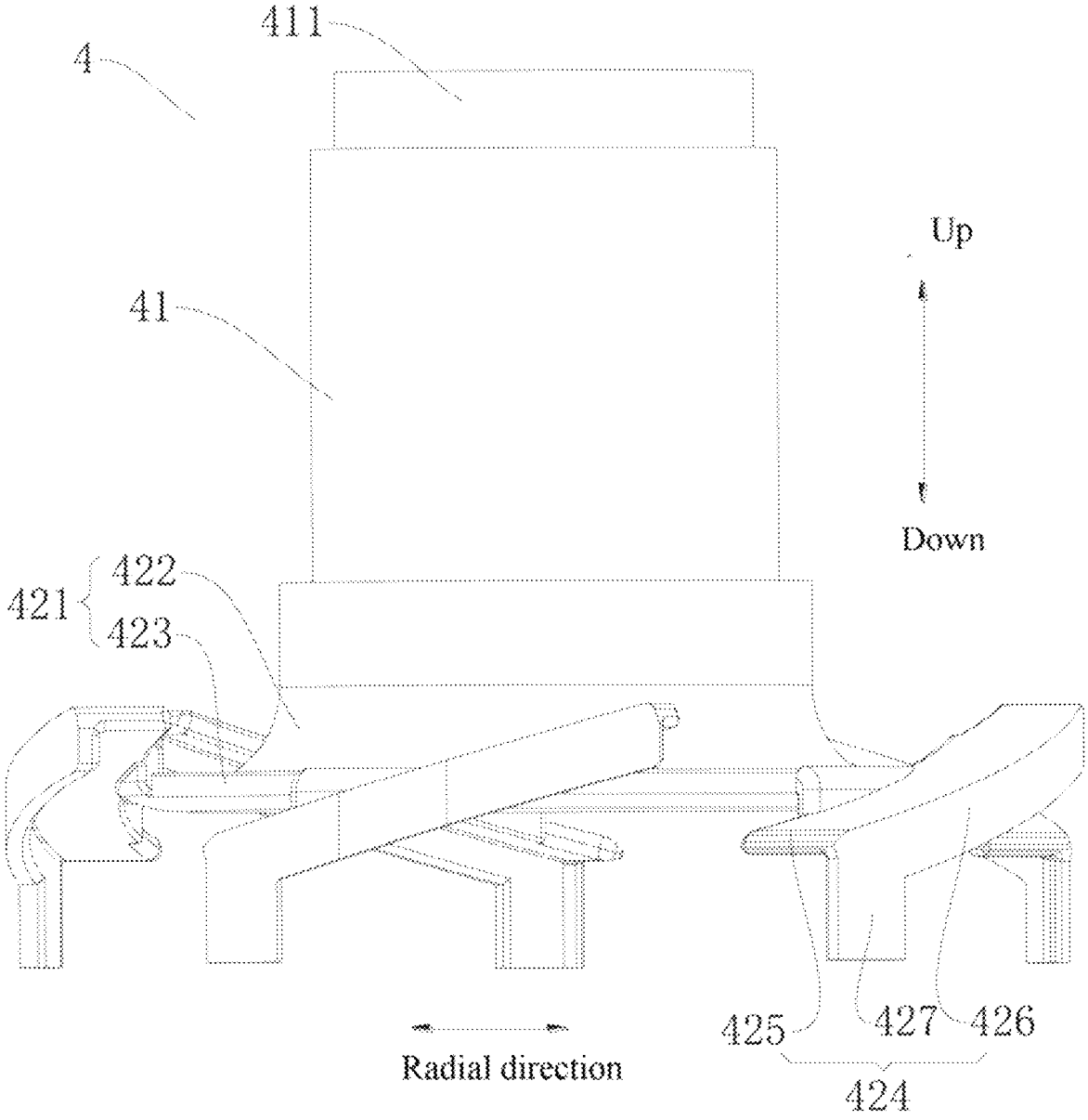
FIG. 6 is a front view of the flow guiding element shown in FIG. 2.

For example, as shown in FIG. 5 and FIG. 6, the upper end of the connection body 421 is connected to the lower end of the water inlet portion 41. The lower end of the connection body 421 may axially extend downwards and radially extend outwards to form a flared shape. In this way, the flow guiding element 4 can easily cover a top of the drive device 3. The plurality of flow guiding ribs 424 is disposed at a peripheral edge of the lower end of the connection body 421 and arranged at intervals in the circumferential direction of the connection body 421.

Further, a cross-sectional area of at least part of the connection body 421 gradually increases from an end of the connection body 421 adjacent to the water inlet portion 41 to an end of the connection body 421 facing away from the water inlet portion 41. The at least part of the connection body 421 covers an impeller assembly 31 of the drive device 3. The connection body 421 is spaced apart from the impeller assembly 31 in an axial direction of the impeller assembly 31. In this way, it can be ensured that water flow entering the water inlet portion 41 can be completely pressurized and accelerated by the impeller assembly 31.

For example, as shown in FIG. 6, in an axial direction of the connection body 421, a cross-sectional area of a lower half part of the connection body 421 gradually increases away from the water inlet portion 41. The drive device 3 is disposed at a lower side of the flow guiding element 4. The impeller assembly 31 is disposed at the top of the drive device 3. The connection body 421 may cover a top of the impeller assembly 31 and be spaced apart from the impeller assembly 31 in an up-down direction. In this way, water flows entering from the water inlet portion 41 can be completely pressurized and accelerated by the impeller assembly 31. As a result, the heat collecting pump 100 can output water flow with a sufficient pressure and velocity.

According to some embodiments of the present disclosure, the water inlet portion 41 includes a circular tube segment. The connection body 421 includes a transition segment 422 and a disc segment 423. The circular tube segment and the disc segment 423 are connected by the transition segment 422. The plurality of flow guiding ribs 424 is arranged at an outer edge of the disc segment 423. The circular tube segment and the disc segment 423 are concentrically arranged to each other.

For example, as shown in FIG. 5 and FIG. 6, the water inlet portion 41 is formed into a circular tube shape. An upper half part of the transition segment 422 may be formed as a straight segment for connecting with the lower end of the water inlet portion 41. A lower half part of the transition segment 422 may axially extend away from the water inlet portion 41 and radially extends outwards. The disc segment 423 is formed into a plate shape horizontally extending outwards. The disc segment 423 is connected to the transition segment 422. The plurality of flow guiding ribs 424 is arranged at intervals at the outer edge of the disc segment 423 in a circumferential direction of the disc segment 423.

The present disclosure is not limited to the above. In other embodiments of the present disclosure, the plurality of flow guiding ribs 424 may be disposed on an outer side wall of the water inlet portion 41, and arranged at intervals in a circumferential direction of the water inlet portion 41.

In an example, the water inlet portion 41 and the flow guiding portion 42 are integrally formed. In this way, processing can be facilitated. In addition, a structural strength of the flow guiding element 4 is improved.

According to some embodiments of the present disclosure, as shown in FIG. 6, the flow guiding ribs 424 may spirally extend in an axial direction of the water inlet portion 41 and are formed as spiral ribs. The plurality of flow guiding ribs 424 is arranged at equal intervals in parallel in the circumferential direction of the connection body 421. In this way, the water flow pressurized by the drive device 3 can flow through a gap between two adjacent flow guiding ribs 424 of the plurality of flow guiding ribs 424. Moreover, a flow direction of the water flow guided by the flow guiding rib 424 is changed to be parallel to an extending direction of the flow guiding ribs 424. In this way, when the water flow flows through the fluid outlet 12, since a tangential direction of the swirly water flow is the same as the opening orientation of the fluid outlet 12, the water flow can flow directly out of the fluid outlet 12, reducing a resistance of the housing 1 to the water flow.

According to some embodiments of the present disclosure, an outer peripheral wall of the water inlet portion 41 at least partially has a cylindrical surface. For example, as shown in FIG. 5 and FIG. 6, the water inlet portion 41 may be formed in a circular tube shape, or a part of the water inlet portion 41 along an axial length of the water inlet portion 41 may be formed in a circular tube shape. In some embodiments, the water inlet portion 41 is formed in the circular tube shape. In this way, a connection of the water inlet portion 41 with the fluid inlet 11 is facilitated. Meanwhile, the number of edges and corners in the fluid discharge channel can be reduced. Therefore, a water flow resistance can be reduced to some extent.

Further, referring to FIG. 6, the flow guiding rib 424 may have a first flow guiding surface and a second flow guiding surface. In an exemplary embodiment of the present disclosure, the first flow guiding surface spirally extends in the axial direction of the water inlet portion 41. The first flow guiding surface is radially perpendicular to the cylindrical surface, i.e., the first flow guiding surface is perpendicular to the outer peripheral wall of the water inlet portion 41. Meanwhile, the first flow guiding surface and the outer peripheral wall of the water inlet portion 41 are radially spaced apart from each other. In this way, the water flow can flow through a gap between the first flow guiding surface and the peripheral wall of the water inlet portion 41 after being pressurized by the first flow guiding surface. As a result, a circulation area of the water flow is increased, improving circulation efficiency of the water flow.

The second flow guiding surface extends spirally in the axial direction of the water inlet portion 41 and is parallel to the cylindrical surface, i.e., the second flow guiding surface is parallel to the outer peripheral wall of the water inlet portion 41. The second flow guiding surface may be connected to a radial outer edge of the first flow guiding surface. In this way, it is convenient to realize a purpose of covering an exterior of the impeller assembly 31. Meanwhile, diffusion of the water flow entering from the water inlet portion 41 to the surroundings when impacting the impeller assembly 31 can be reduced, which is more conducive to convergence of the water flow.

Further, as shown in FIG. 5 and FIG. 6, the flow guiding rib 424 includes a transverse side plate 425 and a longitudinal side plate 426. The transverse side plate 425 extends transversely (i.e., extends in a radial direction of the water inlet portion 41). The longitudinal side plate 426 extends longitudinally (i.e., extends in the axial direction of the water inlet portion 41). The first flow guiding surface is located at a lower surface of the transverse side plate 425. The second flow guiding surface is located at an inner surface of the longitudinal side plate 426. The first flow guiding surface and the second flow guiding surface are connected in the extending direction of the flow guiding rib 424. Moreover, the second flow guiding surface is connected to the outer edge of the first flow guiding surface. Therefore, the structure is simple and it is easy to be processed.

In some embodiments, at least part of the first flow guiding surface is located at a side of the connection body 421 facing away from the water inlet portion 41. A width of the at least part of the first flow guiding surface is constant or gradually decreases from the connection body 421 to a free end of the at least part of the first flow guiding surface.

For example, as shown in FIG. 6, in the up-down direction, the at least part of the first flow guiding surface is located underneath a plane on which the disc segment 423 of the connection body 421 is located. Further, in an axially downward direction, the width of the at least part of the first flow guiding surface may be constant or gradually decrease. In this way, on the one hand, the processing can be facilitated, and on the other hand, the water flow can easily flow through the flow guiding portion 42. In other embodiments of the present disclosure, the first flow guiding surface may be entirely located underneath the plane on which the disk segment 423 of the connection body 421 is located.

In some other embodiments, at least part of the first flow guiding surface is located at a side of the connection body 421 adjacent to the water inlet portion 41. Further, a width of the at least part of the first flow guiding surface is constant or gradually decreases from the connection body 421 to a free end of the at least part of the first flow guiding surface.

For example, as shown in FIG. 6, in the up-down direction, the at least part of the first flow guiding surface is located above the plane on which the disc segment 423 of the connection body 421 is located. Further, in an axially upward direction, the width of the at least part of the first flow guiding surface may be constant or gradually decrease. In this way, on the one hand, the processing can be facilitated, and on the other hand, the water flow can easily flow through the gap between the first flow guiding surface and the peripheral wall of the water inlet portion 41 to the fluid outlet 12. The present disclosure is not limited in this regard. The first flow guiding surface may be entirely located above the plane on which the disk segment 423 of the connection body 421 is located.

Figure 4:
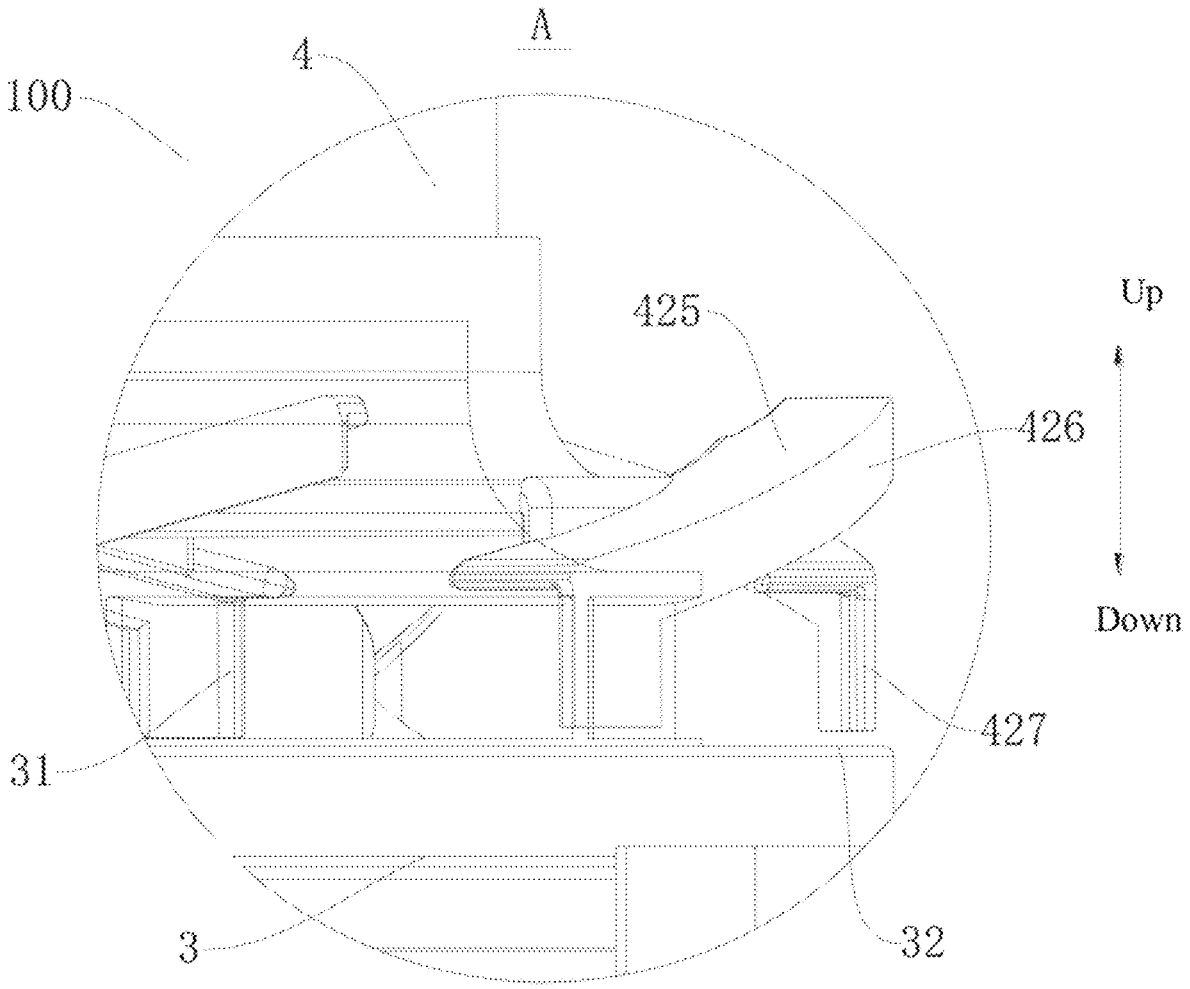
FIG. 4 is a schematic enlarged view at part A shown in FIG. 3.

According to some embodiments of the present disclosure, referring to FIG. 3, FIG. 4, and FIG. 6, the flow guiding rib 424 may further include a support leg 427. In an exemplary embodiment of the present disclosure, the support leg 427 has an upper end connected to the longitudinal side plate 426 and a lower end extending away from the water inlet portion 41. The support leg 427 is adapted to support the drive device 3. Further, the support leg 427 is adapted to be supported at an impeller mounting surface 32 of the drive device 3. It needs to be emphasized that a height of the support leg 427 should ensure an appropriate distance between the connection body 421 and the impeller assembly 31, to facilitate the discharge of the water flow.

Further, for example, as shown in FIG. 5 and FIG. 6, the support leg 427 has a support surface. The flow guiding rib 424 has a second flow guiding surface. The support surface is parallel to the second flow guiding surface. In some embodiments, the support surface and the second flow guiding surface are located on one plane. Therefore, the structure is simple and it is easy for processing.

According to some embodiments of the present disclosure, the drive device 3 is located at a side of the flow guiding element 4 in an axial direction of the flow guiding element 4 (for example, the lower side of the flow guiding element 4 shown in FIG. 2). The drive device 3 includes an impeller assembly 31. The flow guiding portion 42 is supported at an outer side of an outer surface of the impeller assembly 31. Meanwhile, the flow guiding portion 42 is spaced apart from the impeller assembly 31. In this way, both the flowing of the water flow and flow guiding can be facilitated.

Further, the flow guiding portion 42 has a first flow guiding surface. A distance between an end of the first flow guiding surface adjacent to the drive device 3 and an end of the impeller assembly 31 facing away from the flow guiding element 4 ranges from ⅓ to ¾ of a thickness of the impeller assembly 31 in an axial direction of the impeller assembly 31. As shown in FIG. 6, a distance between a lower end of the first flow guiding surface and the impeller mounting surface 32 of the drive device 3 is ⅓, ½, or ¾ of the thickness of the impeller assembly 31 in the axial direction of the impeller assembly 31. In some embodiments, a distance between the lowest end of the first flow guiding surface in an axial direction of the first flow guiding surface and the impeller mounting surface 32 of the drive device 3 is ½ of the thickness of the impeller assembly 31 in the axial direction of the impeller assembly 31. In this way, an enough space between the flow guiding element 4 and the impeller mounting surface 32 can be ensured for the circulation of the water flow. Further, delivery efficiency of the water flow is ensured.

According to some embodiments of the present disclosure, referring to FIG. 2 and FIG. 3, the flow guiding element 4 is provided with an inserting portion 411 adapted to be inserted and engaged into the fluid inlet 11. In an exemplary embodiment of the present disclosure, the inserting portion 411 of the flow guiding element 4 is formed at an end of the water inlet portion 41 in the axial direction of the water inlet portion 41. An outer diameter of the inserting portion 411 may be smaller than an outer diameter of the water inlet portion 41. In this way, insertion of the inserting portion 411 into the fluid inlet 11 is facilitated, or the outer peripheral wall of the water inlet portion 41 can be in an interference fit with an inner peripheral wall of the fluid inlet 11, to realize a connection of the flow guiding element 4 with the housing 1. Further, an engagement groove may be formed at the inner peripheral wall of the fluid inlet 11. A protrusion may be formed at an outer peripheral wall of the inserting portion 411. The engagement groove and the protrusion are engaged with each other to restrict a circumferential rotation of the flow guiding element 4 under an action of the water flow, and thus better flow guiding can be provided.

A heat collecting pump 100 according to an exemplary embodiment of the present disclosure will be described below with reference to FIG. 1 to FIG. 6.

First Embodiment

In an exemplary embodiment of the present disclosure, a heat collecting pump 100 according to the embodiments of the present disclosure includes a housing 1, a heating device 2, a drive device 3, and a flow guiding element 4.

The housing 1 is formed in a cylindrical shape with an open lower end, and has an accommodation cavity. The housing 1 has a fluid inlet 11, a fluid outlet 12, and a mounting opening 13 formed on the housing 1. The fluid inlet 11 is formed at a top of the housing 1. Both the fluid outlet 12 and the mounting opening 13 are formed at a side wall of the housing 1 and spaced apart from each other in a circumferential direction of the housing 1. Both the fluid outlet 12 and the mounting opening 13 are formed adjacent to the top of the housing 1.

The heating device 2 includes a fixing portion, a heating tube 22, and a wiring terminal 21. The fixing portion is fixed to an inner wall of the mounting opening 13. The heating tube 22 is disposed in the accommodation cavity of the housing 1. The wiring terminal 21 extends out of the mounting opening 13 to be connected to an external power source.

The drive device 3 is connected to the open end of the housing 1. An impeller mounting surface 32 is located on an end of the drive device 3 facing towards the accommodation cavity. The impeller assembly 31 is mounted on the impeller mounting surface 32.

The flow guiding element 4 covers the impeller mounting surface 32 and is spaced apart from the impeller assembly 31. The flow guiding element 4 includes a water inlet portion 41 and a flow guiding portion 42. The water inlet portion 41 is formed in a tube shape. An upper end of the water inlet portion 41 is connected to the fluid inlet 11. The heating tube 22 is sleeved around the water inlet portion 41 and spaced apart from the water inlet portion 41. An inner wall of the water inlet portion 41 has a fluid inlet channel. An outer wall of the flow guiding element 4 and an inner wall of the housing 1 define a fluid discharge channel. A bottom of the fluid inlet channel and a bottom of the fluid discharge channel are in communication with each other. The impeller assembly 31 of the drive device 3 is located at the bottom of the fluid inlet channel and the bottom of the fluid discharge channel.

The flow guiding portion 42 includes a connection body 421 and a plurality of flow guiding ribs 424. The connection body 421 includes a transition segment 422 and a disc segment 423. An upper end of the transition segment 422 is connected to a lower end of the water inlet portion 41. A cross-sectional area of the transition segment 422 gradually increases away from the water inlet portion 41 in an axial direction of the water inlet portion 41. The disc segment 423 is connected to a lower end of the transition segment 422 and formed in an annular plate shape.

The plurality of flow guiding ribs 424 is arranged at equal intervals in parallel in a circumferential direction of the disk segment 423. Each of the plurality of flow guiding ribs 424 includes a transverse side plate 425, a longitudinal side plate 426, and a support leg 427. The transverse side plate 425 spirally extends in an axial direction of the water inlet portion 41 and is perpendicular to an outer peripheral wall of the water inlet portion 41. A lower surface of the transverse side plate 425 is formed as a first flow guiding surface. The longitudinal side plate 426 spirally extends in the axial direction of the water inlet portion 41 and is parallel to the outer peripheral wall of the water inlet portion 41. An inner surface of the longitudinal side plate 426 is formed as a second flow guiding surface. An outer edge of the first flow guiding surface is connected to an upper edge of the second flow guiding surface. The support leg 427 extends in the axial direction of the water inlet portion 41. An upper end of support leg 427 is connected to a lower end of the longitudinal side plate 426. A plurality of support legs 427 and the plurality of flow guiding ribs 424 are in one-to-one correspondence. A lower end of the support leg 427 is supported on the impeller mounting surface 32 of the drive device 3. Therefore, the flow guiding element 4 covers an exterior of the impeller assembly 31.

When the heat collecting pump 100 according to this embodiment is in operation, an exemplary flow direction of the water flow is described below. The water flow enters from the fluid inlet 11 into the fluid inlet channel and reaches the bottom of the fluid inlet channel in an extending direction of the fluid inlet channel. After passing through the impeller assembly 31 for pressurization and acceleration, the water flow flows in an opposite direction. When the water flow passes through the flow guiding ribs 424, the water flow is in a swirly shape. The water flow continues to spirally flow upwards in the fluid discharge channel. During this process, the heating device 2 may always heat the water flow in the fluid discharge channel. The heated water flow is finally discharged through the fluid outlet 12.

Second Embodiment

This embodiment is substantially the same as the first embodiment in structure. Therefore, the same reference numerals are used for identical components. The only difference is that the flow guiding ribs 424 are formed at a peripheral edge of the disc segment 423 of the connection body 421 in the first embodiment, while the flow guiding ribs 424 may be formed at a peripheral wall of the water inlet portion 41 in the second embodiment.

Other configurations of the heat collecting pump 100, such as the heating device 2, and operations of the heat collecting pump 100 according to the embodiments of the present disclosure are known to those of ordinary skill in the art, and the detailed description thereof will be omitted herein.

A washing appliance according to embodiments of a second aspect of the present disclosure will described below.

The washing appliance according to the embodiments of the second aspect of the present disclosure includes the heat collecting pump 100 as described in the embodiments of the first aspect of the present disclosure.

In the washing appliance according to the present disclosure, by providing the heat collecting pump 100 as described in the above embodiments of the first aspect, the fluid efficiency can be improved.

Further, the washing appliance as described in the above embodiments may be a dishwasher, a washing machine, or the like In the description of the present disclosure, it needs to be understood that, orientation or position relationship indicated by terms such as "center," "longitudinal," "lateral," "length," "width," "thickness," "over," "below," "front," "back," "left," "right," "vertical," "horizontal," "top," "bottom," "in," "out", "clockwise," "anti-clockwise," "axial," "radial" and "circumferential" is based on the orientation or position relationship shown in the accompanying drawings, and is merely for the convenience of describing the present disclosure and simplifying the description, rather than indicating or implying that the associated device or element must have a specific orientation, or be constructed and operated in a specific orientation, and therefore cannot be understood as a limitation on the present disclosure.

In addition, terms such as "first" and "second" are used herein for purposes of description and are not intended to indicate or imply relative importance or implicitly indicating the number of indicated technical features. Therefore, the feature associated with "first" and "second" may include one or more this feature distinctly or implicitly. In the description of the present disclosure, the term "plurality" means two or more, unless defined otherwise explicitly and specifically.

In the present disclosure, unless otherwise clearly specified and limited, terms such as "install," "connect," "connect to," "fix," and the like should be understood in a broad sense. For example, it may be a fixed connection or a detachable connection or connection as one piece; mechanical connection or electrical connection or communication; direct connection or indirect connection through an intermediate; internal communication of two components or the interaction relationship between two components. For those of ordinary skill in the art, the specific meaning of the above terms in the present disclosure should be understood according to specific circumstances.

In descriptions of the present disclosure, descriptions with reference to the terms "an embodiment," "some embodiments," "examples," "specific examples," or "some examples" etc., mean that specific features, structure, materials, or characteristics described in conjunction with the embodiment or example are included in at least one embodiment or example of the present disclosure. In this specification, the schematic representations of the above terms do not necessarily refer to the same embodiment or example. Moreover, the described specific features, structures, materials or characteristics may be combined in any one or more embodiments or examples in a suitable manner. In addition, those skilled in the art can combine the different embodiments or examples and the features of the different embodiments or examples described in this specification without contradicting each other.

Although the embodiments of the present disclosure have been shown and described above, it can be understood by those of ordinary skill in the art that various changes, modifications, replacements, and variations can be made to these embodiments without departing from the principles and spirits of the present disclosure. The scope of the present disclosure is defined by the claims as appended and their equivalents.

What is claimed is:

1. A heat collecting pump comprising:

a housing with an accommodation cavity, the housing having a fluid inlet and a fluid outlet;

a heating device disposed in the accommodation cavity;

a drive device connected to the housing and configured to drive a fluid to flow from the fluid inlet to the fluid outlet; and a flow guiding element disposed in the accommodation cavity;

wherein:

the flow guiding element has an inner wall forming a fluid inlet channel in communication with the fluid inlet;

a fluid discharge channel is formed between an outer wall of the flow guiding element and an inner wall of the accommodation cavity, the fluid discharge channel being in communication with the fluid inlet channel and the fluid outlet;

the flow guiding element includes:

a flow guiding portion configured to guide a fluid in the fluid discharge channel towards the fluid outlet; and a water inlet portion;

the heating device includes a heating tube sleeved on and spaced apart from the water inlet portion;

the flow guiding portion includes:

a connection body having an end connected to the water inlet portion and another end obliquely extending outwards away from the water inlet portion; and a plurality of flow guiding ribs arranged at intervals at another end of the connection body in a circumferential direction of the connection body;

at least part of an outer peripheral wall of the water inlet portion has a cylindrical surface; and each of the plurality of flow guiding ribs has:

a first flow guiding surface spirally extending in the axial direction of the water inlet portion, the first flow guiding surface being perpendicular to the cylindrical surface; and a second flow guiding surface spirally extending in the axial direction of the water inlet portion, the second flow guiding surface being parallel to the cylindrical surface.

2. The heat collecting pump according to claim 1, wherein:

the water inlet portion has an inner wall forming the fluid inlet channel;

the water inlet portion has an end directly facing towards the fluid inlet; and the flow guiding portion is disposed at another end of the water inlet portion.

3. The heat collecting pump according to claim 2, wherein:

the water inlet portion abuts against the housing at the fluid inlet; and the flow guiding portion abuts against the drive device.

4. The heat collecting pump according to claim 1, wherein:

a cross-sectional area of at least part of the connection body gradually increases from an end of the connection body adjacent to the water inlet portion to an end of the connection body facing away from the water inlet portion; and the at least part of the connection body covers an impeller of the drive device, and is spaced apart from the impeller in an axial direction of the impeller.

5. The heat collecting pump according to claim 1, wherein:

the water inlet portion includes a circular tube segment;

the connection body includes a disc segment and a transition segment connected to the circular tube segment and the disc segment;

the plurality of flow guiding ribs are arranged at an outer edge of the disc segment; and the circular tube segment and the disc segment are concentrically arranged with respect to each other.

6. The heat collecting pump according to claim 1, wherein:

the plurality of flow guiding ribs are arranged at equal intervals in parallel in a circumferential direction of the connection body.

7. The heat collecting pump according to claim 1, wherein:

the flow guiding rib includes a transverse side plate extending transversely and a longitudinal side plate extending longitudinally;

the first flow guiding surface is located at the transverse side plate;

the second flow guiding surface is located at the longitudinal side plate; and the first flow guiding surface and the second flow guiding surface are connected to each other in an extending direction of the flow guiding rib.

8. The heat collecting pump according to claim 7, wherein the flow guiding rib further includes a support leg having an end connected to the longitudinal side plate and another end extending away from the water inlet portion, and the support leg is configured to support the drive device.

9. The heat collecting pump according to claim 8, wherein the support leg has a support surface parallel to the second flow guiding surface.

10. The heat collecting pump according to claim 1, wherein:

at least part of the first flow guiding surface is located at a side of the connection body facing away from the water inlet portion; and a width of the at least part of the first flow guiding surface is constant or gradually decreases from the connection body to a free end of the at least part of the first flow guiding surface.

11. The heat collecting pump according to claim 1, wherein:

at least part of the first flow guiding surface is located at a side of the connection body adjacent to the water inlet portion; and a width of the at least part of the first flow guiding surface is constant or gradually decreases from the connection body to a free end of the at least part of the first flow guiding surface.

12. The heat collecting pump according to claim 1, wherein:

the drive device is located at a side of the flow guiding element in an axial direction of the flow guiding element;

the drive device includes an impeller assembly; and the flow guiding portion is supported at an outer side of the impeller assembly.

13. The heat collecting pump according to claim 12, wherein:

the flow guiding portion has a flow guiding surface; and a distance between an end of the flow guiding surface adjacent to the drive device and an end of the impeller assembly facing away from the flow guiding element ranges from ⅓ to ¾ of a thickness of the impeller assembly in an axial direction of the impeller assembly.

14. The heat collecting pump according to claim 1, wherein the flow guiding element is provided with an inserting portion configured to be inserted and engaged into the fluid inlet.

15. A washing appliance comprising a heat collecting pump including:

a housing with an accommodation cavity, the housing having a fluid inlet and a fluid outlet;

a heating device disposed in the accommodation cavity;

a drive device connected to the housing and configured to drive a fluid to flow from the fluid inlet to the fluid outlet; and a flow guiding element disposed in the accommodation cavity;

wherein:

the flow guiding element has an inner wall forming a fluid inlet channel in communication with the fluid inlet;

a fluid discharge channel is formed between an outer wall of the flow guiding element and an inner wall of the accommodation cavity, the fluid discharge channel being in communication with the fluid inlet channel and the fluid outlet;

the flow guiding element includes:

a flow guiding portion configured to guide a fluid in the fluid discharge channel towards the fluid outlet; and a water inlet portion;

the heating device includes a heating tube sleeved on and spaced apart from the water inlet portion;

the flow guiding portion includes:

a connection body having an end connected to the water inlet portion and another end obliquely extending outwards away from the water inlet portion; and a plurality of flow guiding ribs arranged at intervals at another end of the connection body in a circumferential direction of the connection body;

at least part of an outer peripheral wall of the water inlet portion has a cylindrical surface; and each of the plurality of flow guiding ribs has:

a first flow guiding surface spirally extending in the axial direction of the water inlet portion, the first flow guiding surface being perpendicular to the cylindrical surface; and a second flow guiding surface spirally extending in the axial direction of the water inlet portion, the second flow guiding surface being parallel to the cylindrical surface.

16. The washing appliance according to claim 15, wherein:

the water inlet portion has an inner wall forming the fluid inlet channel;

the water inlet portion has an end directly facing towards the fluid inlet; and the flow guiding portion is disposed at another end of the water inlet portion.

17. The washing appliance according to claim 16, wherein:

the water inlet portion abuts against the housing at the fluid inlet; and the flow guiding portion abuts against the drive device.

18. The heat collecting pump according to claim 1, wherein:

the water inlet portion has an inner wall forming the fluid inlet channel;

the water inlet portion has an end directly facing towards the fluid inlet;

the flow guiding portion is disposed at another end of the water inlet portion; and the plurality of flow guiding ribs are arranged at equal intervals in parallel in a circumferential direction of the connection body.

* * * * *